United States Patent [19]

Boone

[11] Patent Number: 4,953,345

[45] Date of Patent: Sep. 4, 1990

[54] HORSE BRIDLE

[75] Inventor: Raymond N. Boone, New Haven, Ky.

[73] Assignee: Leatherhead Shop, Inc., Louisville, Ky.

[21] Appl. No.: 222,711

[22] Filed: Jul. 21, 1988

[51] Int. Cl.[5] ..... B68B 1/04

[52] U.S. Cl. ..... 54/6 R; 54/13

[58] Field of Search ..... 54/6 R, 6 A, 12, 13

[56] References Cited

U.S. PATENT DOCUMENTS 299,174 5/1884 Shay ..... 54/6 R
815,703 3/1906 Hay-Hay ..... 54/6 R
3,981,124 9/1976 Kibler ..... 54/6 R
4,132,054 1/1979 Mader ..... 54/6 R

*Primary Examiner*—Robert P. Swiatek
*Attorney, Agent, or Firm*—Woodard, Emhardt, Naughton Moriarty & McNett

[57] ABSTRACT

A horse bridle with a crown, spare crown, upper cheek straps, lower cheek straps and brow band all made from the same bridle blank and attached together by buckles so that the spare crown can be used as an emergency replacement should any of these other components break.

11 Claims, 4 Drawing Sheets

HORSE BRIDLE

BACKGROUND OF THE INVENTION

The present invention relates to horse bridles and more particularly to the construction of horse bridles which provides for interchangeability of various parts.

Currently manufactured conventional horse bridles are comprised of approximately nine major components that are machine sewn or hand stitched together. The rigors of normal usage and perspiration from the horse can cause the horse bridle to fail due to their action on the stitching at points of stress. The bridle must then be returned by the owner to a saddle and harness shop for repair.

The inventor is aware of U.S. Pat. No. 291,596 issued Jan. 8, 1884 to Hitt which discloses a horse bridle which is designed with a cheek strap doubled upon itself so that different surfaces of the cheek strap can be presented at the point of connection to the bit to reduce wear to any particular surface. The Hitt bridle uses buckles for the connectors between the various components of the bridle rather than stitching. The Hitt bridle does not provide an additional strap which can be used to replace a broken component but instead attempts to avoid breakage by allowing the surface at the point of connection to be changed. Eventually, the Hitt bridle will be subject to breakage and will not be able to be immediately repaired by the owner.

SUMMARY OF THE INVENTION

One embodiment of the present invention is a horse bridle having a crown with opposite ends and a pair of cheek straps, each of which is attached to an opposite end of the crown. There are attachment means for attaching the pair of cheek straps to the opposite sides of a bit. A spare crown having opposite ends removably attached to the pair of cheek straps is provided. The spare crown is also designed and arranged to be removed from the pair of cheek straps to serve as a replacement for the crown or either of the pair of cheek straps.

The current invention's advantages over conventional horse bridles are as follows:

Due to the unique construction and assembly of the invention, there are no stitches to break, causing failure of the horse bridle due to broken stitches. All of the major components comprising the invention buckle together.

The major components of this invention are manufactured from the same piece in blank form, thereby greatly simplifying parts storage, inventory and manufacture of the horse bridle.

Repair of the invention by the owner is made possible due to the fact that there are no stitches in the horse bridle and that the major components may be replaced by the owner by using the spare crown provided. The spare crown is simply buckled into place by the owner to replace the damaged or broken part.

Overcoming the deleterious effects and difficulties of normal machine sewn or hand stitched horse bridles, the present invention is designed to eliminate these problems by offering a simple construction, efficient, durable and praticable solution for manufacturing a horse bridle. The invention provides for a viable solution to currently manufactured horse bridles in that the major parts comprising the horse bridle are made from the same bridle blank.

Other objects and advantages of the invention will become better understood hereinafter from a consideration of the specification with a reference to the accompanying drawing forming part thereof, and in which like numerals correspond to like parts throughout the view of the invention and the corresponding body of the specification, and wherein:

DESCRIPTION OF THE PREFERRED EMBODIMENT

Figure 1:
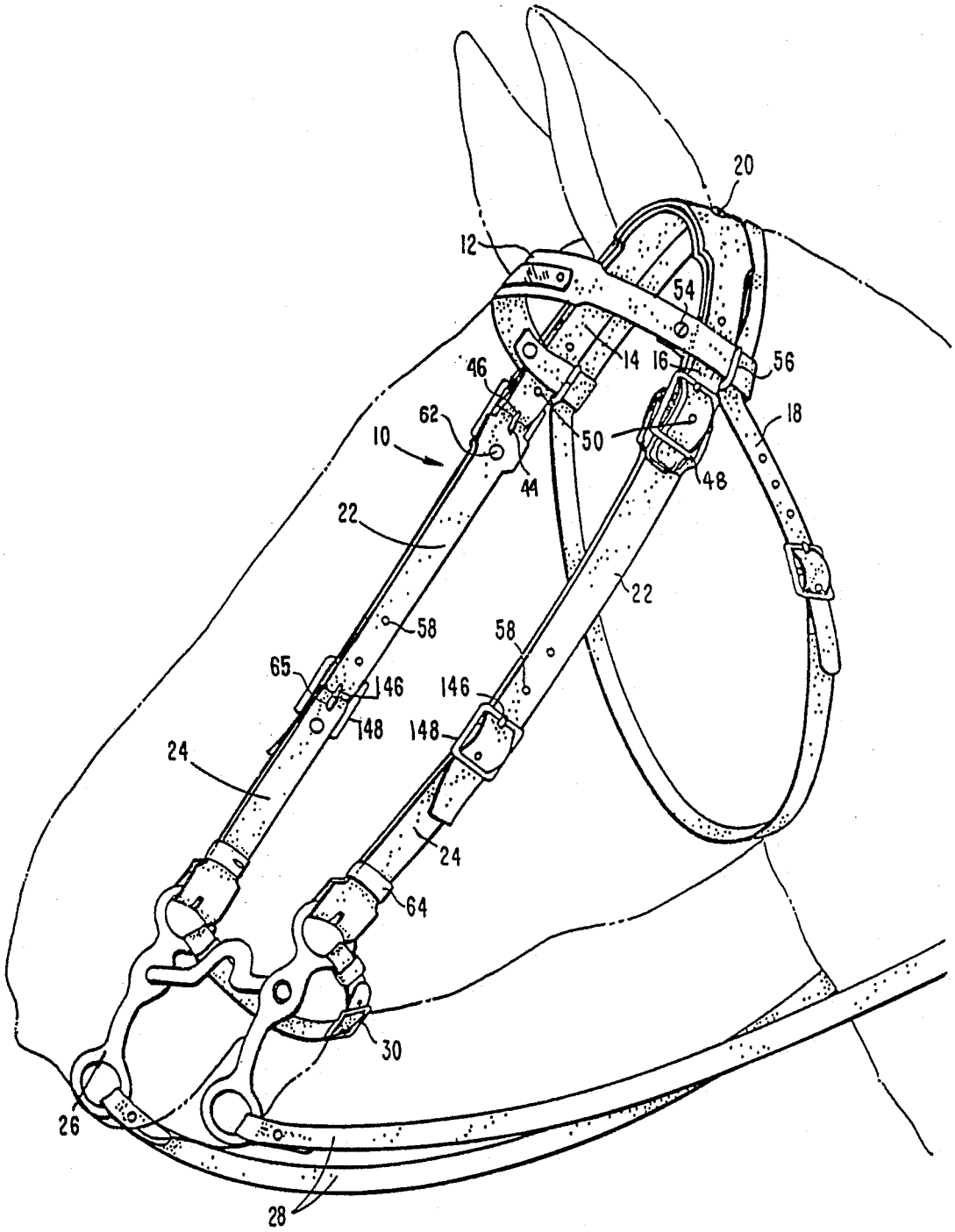
FIG. 1 is a perspective view of the horse bridle according to the present invention as worn by the horse.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
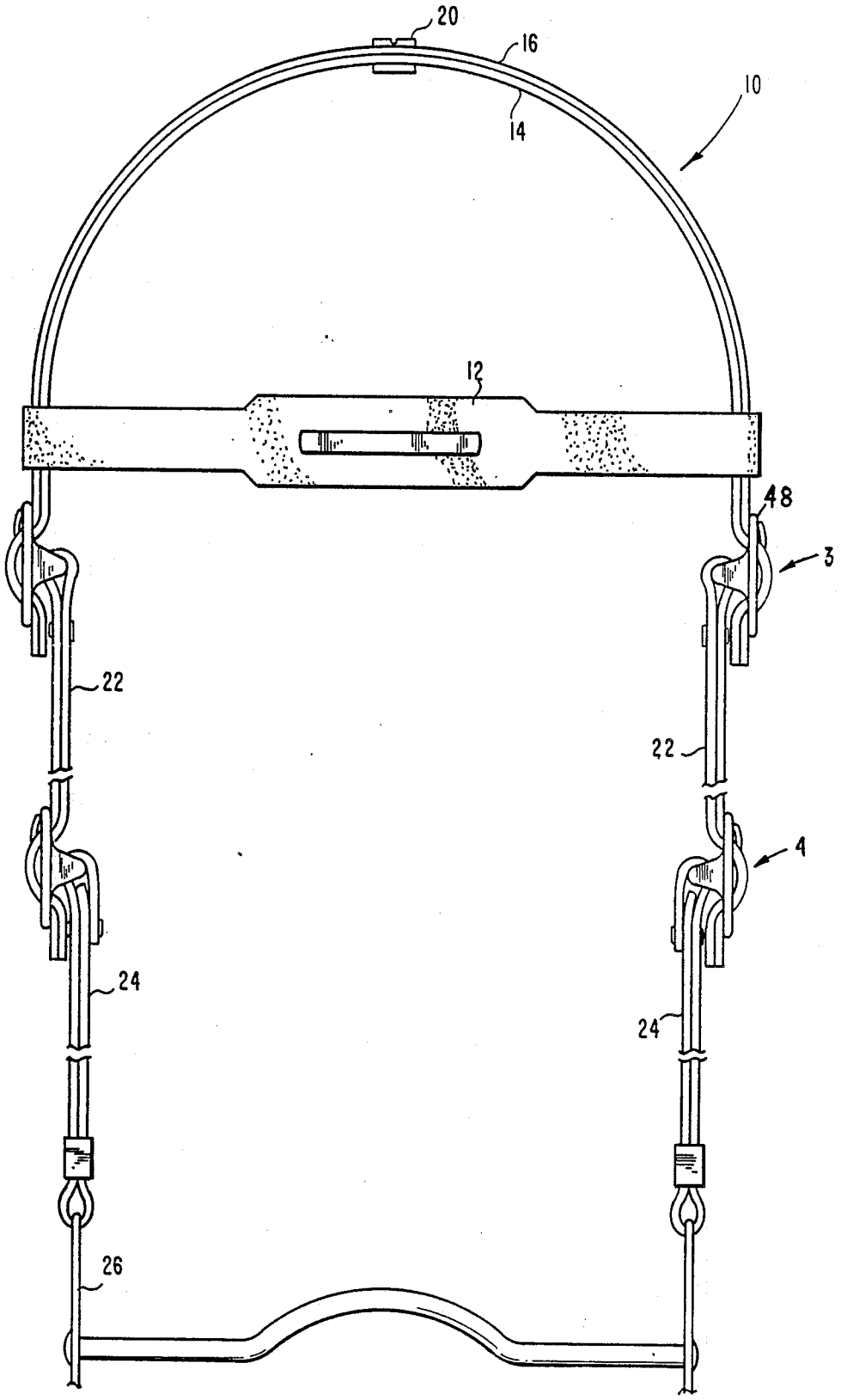
FIG. 2 is a front view of the bridle of FIG. 1 showing only those components which are interchangeable.

Referring to FIGS. 1 and 2, there is illustrated a bridle 10 which has a brow band 12 terminating and attached to a crown 14, spare crown 16 and throat latch 18 (not illustrated in FIG. 2). Crown 14 and spare crown 16 are two identical parts juxtapositioned one upon the other and fastened together by safety screw 20 at their midpoints. Spare crown 16 is to be used in repair of crown 14, brow band 12, upper cheek strap 22 or lower cheek strap 24 should repair be necessary. Crown 14 and spare crown 16 of horse bridle 10 are attached at their terminating points by a buckle 48 to upper cheek strap 22. Upper cheek strap 22 is attached by a buckle 148 at its lower terminus to lower cheek strap 24. Lower cheek strap 24 is then in turn attached to a curb bit 26. The reins 28 and the curb strap 30 are attached to curb bit 26 of horse bridle as shown in FIG. 1. It should be noted that either buckles or safety screws are used to attach the components of the bridle together thereby eliminating stitching which might break.

In the course of manufacturing bridle 10, crown 14, spare crown 16, brow band 12, upper cheek strap 22 and lower cheek strap 24 are all produced from a bridle blank 32. The manufacture of the invention is thus greatly simplified due to the fact that of the major components (crown, spare crown, two upper cheek straps, two lower cheek straps, brow band, throat latch, curb strap, curb bit and reins) comprising the completed horse bridle, six of the pieces (crown, spare crown, two upper cheek straps, two lower cheek straps and brow band) are manufactured from the same blank piece, i.e. bridle blank 32.

Thus, in describing the manner in which a bridle 10 is manufactured, it is best to refer to bridle blank 32 and to describe the alterations made to a bridle blank 32 in order to form the various parts of the bridle 10. Bridle blank 32 is manufactured from a strip of leather which has a thicker medial portion 34 separating two thinner end strips 36 and 38. Bridle blank 32 is manufactured to be symmetrical about a longitudinal axis 40 and also about a lateral axis 42 which is at right angles with longitudinal axis 40. Bridle blank 32 is provided with a longitudinal slot 44 in medial portion 34. Longitudinal slot 44 is symmetrical about longitudinal axis 40 and about lateral axis 42. Longitudinal slot 44 has a width which is sufficient to receive a clasp 46 and/or 146 (see FIG. 1) of a buckle and is also wide enough to receive safety screw 20. This bridle blank 32 is used to manufacture the two lower cheek straps 24, two upper cheek straps 22, the crown 14, spare crown 16 and brow band 12.

In manufacturing a bridle 10, bridle blank 32 is modified according to the component for which it is to be used. For instance, both crown 14 and spare crown 16 have a plurality of adjustment holes 50 punched into their end strips 36 and 38. Adjustment holes 50 are equally spaced on both end strips 36 and 38 and placement of the adjustment holes on each of the end strips is symmetrical about lateral axis 42. Adjustment holes 50 are sized to receive a clasp of a buckle. The spare crown and crown are connected together by safety screw 20 to provide a single doubled crown.

Brow band 12 is formed from bridle blank 32 with the end strips 36 and 38 being looped around crown 14, spare crown 16 and throat latch 18 and then connected together by a safety screw 54. Metal D-rings 56 are juxtaposed between crown 14 and spare crown 16 and throat latch 18 to separate these components as illustrated. Should brow band 12 break during usage, repair can be accomplished by removing safety screw 20 so that spare crown 16 may be removed and looped in the appropriate manner around the crown and the throat latch. The safety screw 20 and safety screws 54 of brow band 12 may be inserted through adjustment holes 50 in the spare crown to connect the spare crown in the appropriate location to serve as a brow band.

Figure 3:
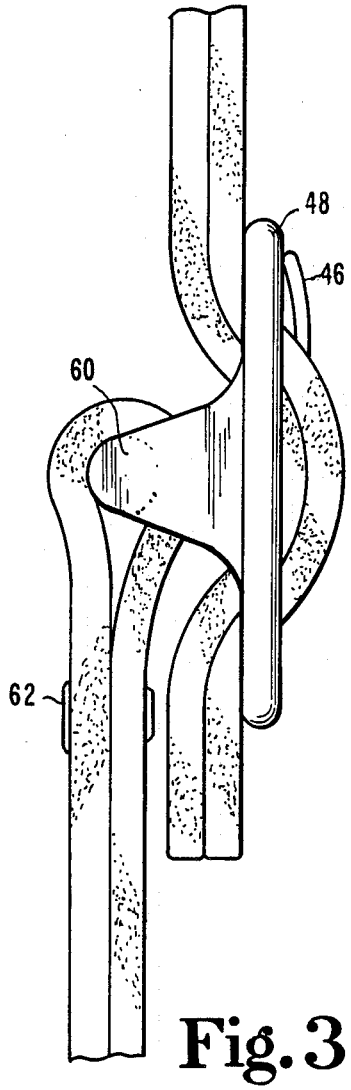
FIG. 3 is a more detailed view of area 3 of FIG. 2.
Figure 5:
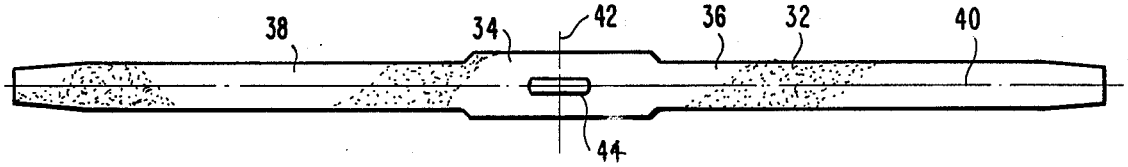
FIG. 5 is a plan view of a bridle blank used to make the components shown in FIG. 2.

Upper cheek straps 22 are formed from a bridle blank 32 which has a plurality of adjustment holes in each of its end strips 36 and 38. These adjustment holes are equally spaced along each end strip and are symmetrically located about axis 42. Upper cheek straps 22 are formed by folding bridle blank 32 about lateral axis 42. Medial portion 34 extends around clasp bar 60 (see FIG. 3 in dotted lines) of buckle 48 with clasp 46 extending through longitudinal slot 44. A safety screw 62 is used to connect the opposite sides of the upper cheek strap together near the buckle 48. Should upper cheek strap 22 be broken during usage, it can be replaced with spare crown 16 by removing the spare crown and folding it in the manner in which the upper cheek strap is folded. For emergency repairs, it is not necessary for safety screw 62 to be inserted in spare crown 16 when the spare crown is used as an emergency upper cheek strap.

Figure 4:
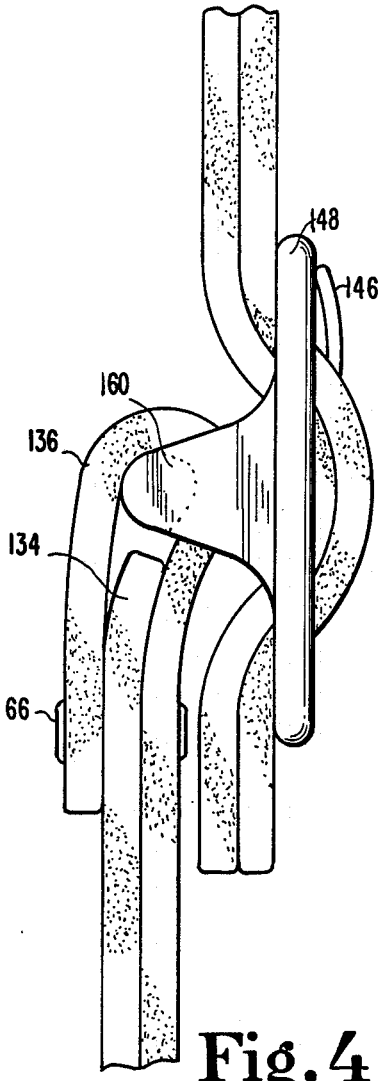
FIG. 4 is a more detailed view of area 4 of FIG. 2.
Figure 6:
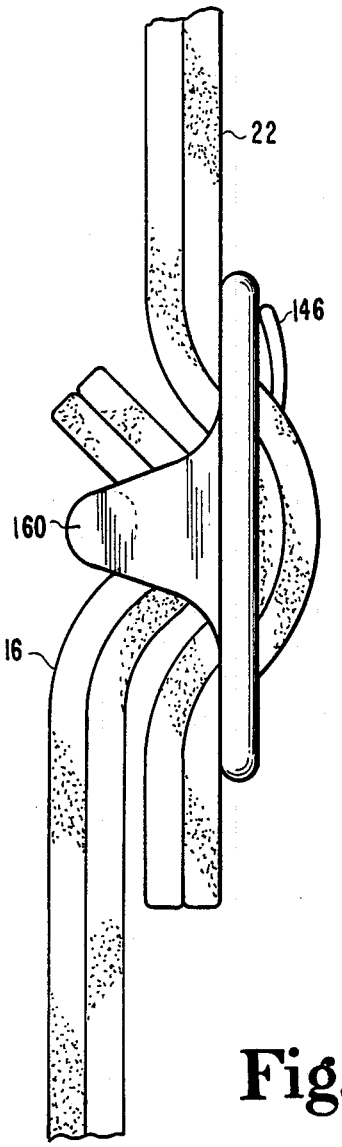
FIG. 6 is a detailed view of area 4 of FIG. 2 when the spare crown is used as an emergency replacement for the lower cheek strap.

The lower cheek strap 24 is formed by folding bridle blank 32 about lateral axis 42 and positioning the bridle blank so that it may be received in an aperture in curb bit 26 as illustrated in FIG. 1. A leather band 64 is used to hold the end strips 36 and 38 together near the medial portion. A longitudinal slot 65 (FIG. 1) of approximately the same size as longitudinal slot 44 is cut in one of the end strips (identified as 136 in FIG. 4) and this end strip is folded upon itself so that it extends around clasp bar 160 of a buckle 148 so that the clasp 146 extends through the longitudinal slot. The other end strip (134 in FIG. 4) is cut off at a shorter distance and end strips 136 and 134 are connected together by a safety screw 66. Should the lower cheek strap break during use, spare crown 16 may be used as an emergency replacement lower cheek strap in the manner illustrated in FIG. 6. Spare crown 16 is removed from the crown as previously described and inserted through the aperture in the curb bit and folded about its longitudinal axis 42. Since the spare crown does not have a longitudinal slot in its end strip 36, it is necessary to have clasp 146 extend through one of the plurality of attachment holes 50 on each of ends 34 and 36 of the spare crown.

Spare crown 16 may be removed from bridle 10 by simply removing safety screw 20 with a suitable coin and unbuckling spare crown 16 at terminating ends with upper cheek straps 22.

Having thus described the invention, it is understood that certain modifications in the construction and arrangement of the parts thereof will be made, as deemed necessary, without departing from the scope of the appended claim.

The invention claimed is:

1. A horse bridle comprising;

a crown having opposite ends;

a pair of cheek straps each of which is attached to an opposite end of said crown;

attachment means for attaching said pair of cheek straps to opposite sides of a bit;

a spare crown having opposite ends removably attached to said pair of cheek straps wherein said spare crown is designed and arranged to be removed from said pair of cheek straps to serve as a replacement for said crown or either of said pair of cheek straps.

2. The bridle of claim 1 wherein said crown, said spare crown and each of said pair of cheek straps have a shape which allows them to each be made from a common bridle blank.

3. The bridle of claim 1 wherein said attachment means comprises a pair of lower cheek straps extending between said cheek straps and said opposite sides of said bit and wherein further said spare crown is designed and arranged to be removed from said pair of cheek straps to serve as a replacement for either of said pair of lower cheek straps.

4. The bridle of claim 3 wherein said spare crown and each of said pair of lower cheek straps have a shape which allows them to each be made from a common bridle blank.

5. The bridle of claim 3 wherein said crown, said spare crown, each of said pair of cheek straps and each of said pair of lower cheek straps have a shape which allows them to each be made from a common bridle blank.

6. The bridle of claim 5 and further comprising a brow band attached to and extending between opposite ends of said crown and wherein said spare crown is designed and arranged to be removed from said pair of cheek straps to serve as a replacement for said brow band.

7. The bridle of claim 6 wherein said spare crown and said brow band have a shape which allows them to each be made from a common bridle blank.

8. The bridle of claim 1 and further comprising a brow band attached to and extending between opposite ends of said crown and wherein said spare crown is designed and arranged to be removed from said pair of cheek straps to serve as a replacement for said brow band.

9. The bridle of claim 8 wherein said spare crown and said brow band have a shape which allows them to each be made from a common bridle blank.

10. A horse bridle, comprising:

a crown having opposite ends;

a pair of upper cheek straps each being releasably connected to a corresponding end of said crown;

attachment means for attaching each of said cheek straps to corresponding sides of a bit, said attachment means including a pair of lower cheek straps extending between said upper cheek straps and said bit; and, wherein said crown, said upper cheek straps and said lower cheek straps are made from a common bridle blank which allows them to be substantially interchangeable.

11. A horse bridle, comprising:

a crown having opposite ends;

a pair of upper cheek straps each being releasably connected to a corresponding end of said crown and wherein said crown and said cheek straps are all made from a common bridle blank which allows them to be substantially interchangeable;

attachment means for attaching each of said cheek straps to corresponding sides of a bit and wherein said attachment means includes a pair of lower cheek straps extending between said upper cheek straps and said bit; and, a spare crown substantially identical to said crown and releasably connected to said cheek straps adjacent said crown and wherein said spare crown may be detached from said upper cheek straps and may replace any one of said crown, an upper cheek strap and a lower cheek strap.

* * * * *